US011160997B2

(12) United States Patent
Van Den Brink et al.

(10) Patent No.: US 11,160,997 B2
(45) Date of Patent: Nov. 2, 2021

(54) TOOL HAVING A PUMP AND A PUMP

(71) Applicant: HOLMATRO B.V., Raamsdonksveer (NL)

(72) Inventors: Titus Ludger Van Den Brink, Breda (NL); Marcus Petrus Augustinus Schellekens, Breda (NL); Remon Vincent Wensveen, Sleeuwijk (NL); Rene Wilhelmus Johannes Van Eindhoven, Oisterwijk (NL)

(73) Assignee: HOLMATRO B.V., Raamsdonksveer (NL)

( * ) Notice: Subject to any disclaimer, the term of this patent is extended or adjusted under 35 U.S.C. 154(b) by 0 days.

(21) Appl. No.: 15/734,838

(22) PCT Filed: Aug. 29, 2019

(86) PCT No.: PCT/EP2019/073136
§ 371 (c)(1),
(2) Date: Dec. 3, 2020

(87) PCT Pub. No.: WO2020/043847
PCT Pub. Date: Mar. 5, 2020

(65) Prior Publication Data

US 2021/0228917 A1 Jul. 29, 2021

(30) Foreign Application Priority Data

Aug. 30, 2018 (NL) ..... 2021528

(51) Int. Cl.
*A62B 3/00* (2006.01)
*B25F 5/00* (2006.01)
(Continued)

(52) U.S. Cl.
CPC ..... *A62B 3/005* (2013.01); *B25F 5/005* (2013.01); *F04B 17/03* (2013.01); *F04B 19/04* (2013.01); *F04B 23/02* (2013.01); *F04B 51/00* (2013.01)

(58) Field of Classification Search
CPC ..... A62B 3/005; B25B 28/00; B25B 27/10; B25B 27/02; B23D 29/00
(Continued)

(56) References Cited

U.S. PATENT DOCUMENTS

2001/0052416 A1* 12/2001 Wissmach ..... B25F 5/00 173/4
2012/0318545 A1* 12/2012 Schreiber ..... B25F 5/00 173/1
(Continued)

FOREIGN PATENT DOCUMENTS

CN 101280845 A 10/2008
CN 102161313 A 8/2011
(Continued)

OTHER PUBLICATIONS

International Search Report and Written Opinion for the International Patent Application No. PCT/EP2019/073136, dated Dec. 3, 2019, 10 pages.
International Search Report and Written Opinion for the International Patent Application No. PCT/EP2019/073124, dated Dec. 3, 2019, 11 pages.

*Primary Examiner* — Nathaniel C Chukwurah
(74) *Attorney, Agent, or Firm* — Kacvinsky Daisak Bluni PLLC

(57) ABSTRACT

A portable tool capable of being moved by persons, users and/or operators includes a motor; an actuable tool component at least connectable to the work cylinder; an add-on from a group at least including an extension, a connection and a fork, configured to be placed on the tool; and a controller connected to the motor and configured to deter-
(Continued)

mine presence of the add-on on the tool to selectively increase or reduce motor force and/or speed, depending on detected presence or absence of the add-on.

10 Claims, 11 Drawing Sheets

(51) Int. Cl.

| | |
|---|---|
| ***F04B 17/03*** | (2006.01) |
| ***F04B 19/04*** | (2006.01) |
| ***F04B 23/02*** | (2006.01) |
| ***F04B 51/00*** | (2006.01) |

(58) Field of Classification Search
USPC ..... 173/1, 46, 170, 171, 48
See application file for complete search history.

(56) References Cited

U.S. PATENT DOCUMENTS

| | | | | |
|---|---|---|---|---|
| 2014/0070924 | A1 | 3/2014 | Wenger et al. | |
| 2016/0363510 | A1* | 12/2016 | Kanack ..... | G01M 99/008 |
| 2018/0021603 | A1* | 1/2018 | Horne ..... | A62B 3/005 254/93 R |

FOREIGN PATENT DOCUMENTS

| | | | |
|---|---|---|---|
| CN | 107614206 | A | 1/2018 |
| EP | 3345656 | A1 | 7/2018 |
| WO | 2017190799 | A1 | 11/2017 |

* cited by examiner

"PRIOR ART"

TOOL HAVING A PUMP AND A PUMP

This is a national stage application filed under 35 U.S.C. § 371 of pending international application PCT/EP2019/073136, filed Aug. 29, 2019, which claims priority to Netherlands Patent Application No. 2021528, filed Aug. 30, 2018, the entirety of which applications are hereby incorporated by reference herein.

The present disclosure relates to a tool, comprising a motor, such as an electric motor, a pump driven by the motor and a cylinder, such as a work cylinder, to activate or drive a tool.

Examples of such tools are rescue tools. Other examples relate to a skidding system, a re-railing system, and synchronous lifting system.

High power tools, such as rescue tools, are traditionally connected to an external pump with one or more hoses running from the pump to the tool to supply hydraulic fluid under pressure to the tool. In such prior configurations, the tool comprised only or at least the cylinder and the actuable tool component.

Alternatively, and as known from EP-3360649 and EP-3345656, a motor may be external from the rescue too, for example in the form of a portable, battery powered screw/drill machine, to be coupled with the rescue tool and provide power thereto.

However, in the field of, in particular, rescue tools, there's a tendency towards self-contained and/or portable tools. To achieve self-contained and portable tools, a tool must be able to compete with traditional systems with an external pump, in terms of size, weight, delivered force, generated speeds and manufacturing as well as sales costs to be competitive, and should therefore be designed in a more compact and lighter manner to allow inclusion of the pump and motor in the tool and ensure manoeuvrability and portability. Additionally a tank or reservoir for hydraulic fluid may also be included, adding to the challenge of keeping the tool compact and portable. Also, operation speed should be at least at the same or a comparable level as that of traditional tools. Further, power consumption (in particular, if a battery is also to be incorporated into a tool's housing) must allow operability during considerable lengths of time, and control must be configured to take power consumption into account to make sure a job gets done, without the tool quitting on the operator in the middle of a rescue operation.

In summary, the inventors of the present disclosure faced the challenge of designing a tool that can be self-contained and/or portable, which is comparable or better than the traditional hose connected tools with respect to the above and other aspects and considerations, such as appropriate cooling capability and the like.

At least some of these desired characteristics for portable and/or self-contained tools, such as rescue tools, also apply for other types of tools, such as the aforementioned skidding systems, re-railing systems, and synchronous lifting systems, in particular compactness of design, costs and generated force, as well as other aspects.

To this end, a portable tool, capable of being moved by persons, users and/or operators, is disclosed. The portable tool can include a motor, an actuable tool component connectable to the motor, an add-on from the group including an extension, a connection, and a fork, configured to be placed on the tool, and a controller connected to the motor and configured to determine presence of the add-on on the tool to selectively increase or reduce force and/or speed, depending on detected presence or absence of the add on.

The add-on may be configured to replace the actuable tool component.

The add-on may comprise an identifier, configured to communicate its presence to the controller. Then, the identifier of the add-on may be configured to proclaim its presence on the tool through a signal over a wire or wirelessly.

In a particular embodiment, the tool may comprise:

the motor;

the pump with a plurality of chambers, each of which comprises a fluid input channel extending from a reservoir to the chamber for fluid supply, a pressurised fluid output port and a piston, wherein the motor is configured to cyclically move the piston in the chamber to supply fluid from the reservoir via the input channel into the chamber during a suction half of the piston cycle and to forcibly press fluid out through the output port during a press half of the piston cycle, wherein the input channel is blocked during the press half of the piston cycle; and the work cylinder in fluid connection with the output ports of the chambers; and the actuable tool component connected to the work cylinder, The controlled valve may be configured to selectively at least substantially block the input channel of at least one of the plurality of chambers of the pump during at least a part of the suction half of the piston cycle, independent of the piston cycle.

In a particular embodiment, a valve may be configured to block the input channel during the press half of the piston cycle, in particular through a mechanical linkage with the piston and the cyclic movement thereof, and the controlled valve is arranged between the reservoir and the valve. Consequently, the controlled valve may be light and simple, since the usually already provided valve for closing the input channel during the press halve of the piston cycle will avoid return of fluid through the input channel to the tank or reservoir, so that the controlled valve need only keep the input channel closed during the low pressure suction halt of the piston cycle. For this a simple flap over an input port may already suffice, since a pressure difference over the controlled valve is as low a ambient or tank pressure (e.g. 1 bar) so that the controlled valve is not required to be able to withstand a pressure difference of up to 10 bar or more, as it would have to when arranged at an output side of the chamber.

In an alternative embodiment, the controlled valve may be configured to block the input channel at least during the press half of the piston cycle. Although thereto, the controlled valve is required to be more sturdy to withstand also the high pressure during the press half of the piston cycle, in contrast with the foregoing embodiment, a simplification may be achieved in terms of numbers of components and control thereof.

In a further particular embodiment of the present disclosure, a bypass from the fluid output port to the reservoir may be provided to comprise the controlled valve configured to selectively open the bypass of at least one of the plurality of chambers of the pump during at least a part of the press half of the piston cycle, independent of the piston cycle. A controlled valve in a bypass may be as simple as in the embodiment of a controlled valve in the input channel between the reservoir and the chamber, where even a simple needle operated non-return valve to be operated by the needle to keep open the bypass for return of fluid from the chamber back to the reservoir, and thus not contributing to the flow of pressurised fluid to the cylinder. This also allows application of the principle of selecting chambers contributing (or not) to the outgoing flow of pressurized fluid, while securing a far simpler solution than heavy and robust closing valves in the output ports in or of channels from the chambers to the work cylinder.

Both feature sets reside within the inventive concept of the present disclosure that a selection of the tool in general and the pump in particular is regulated depending on the sensor readings, where more in detail a selection of chambers of the pump can be made to contribute to the flow of pressurised hydraulic fluid to the cylinder, while avoiding the use of sturdy and voluminous valves in are behind the output port (in the flow direction). Selecting which of the plurality of chambers is allowed to contribute to the flow of fluid to the cylinder allows a for adjusting the pump to internal and external circumstances of the tool, and generate a desired flow with an appropriate pressure to go to the cylinder, depending on the internal and external circumstances, and adjusted thereto. In the meantime, the pump is capable of speed control and controlled force generation, while the design may be very compact, enough so to be included in a portable or possibly even self-contained tool, such as a rescue tool, which may then comprise: a motor; a fluid reservoir; a pump connected to the reservoir and the motor; a work cylinder connected to an output of the pump; an actuable tool component connected to the work cylinder; a sensor in the rescue tool connected to any one or more than one of the motor, the reservoir, the pump, the work cylinder, and the tool; a controller configured to receive measurement signals from the sensor; and at least one controlled valve in a hydraulic circuit defined by the reservoir, the pump and the work cylinder and connected to the controller, wherein the controlled valve and the controller are configured to selectively at least substantially block or open any fluid channel in the hydraulic circuit. Nevertheless other types of tools are by no means excluded from the scope of protection for the present disclosure, as defined in the appended claims.

When the tool is portable or self-contained, and/or the motor is an electric motor, a battery to provide power to the motor for driving the pump may be included in a tool housing and/or may be provided in the shape and form of a separately portable module, such as a battery pack to be carried on a user's back.

The controlled valve in the tool allows for control over operation of the pump or the hydraulic circuit in general, to adapt the tool to the internal or external operational circumstances.

In an additional or alternative embodiment, the tool according to the present disclosure may further comprise a controller configured to control at least one of the controlled valve and the motor. In such an embodiment, the tool may further comprise at least one performance sensor providing, to the controller, information for the controller to adapt at least one of the motor and the controlled valve to the information, wherein the sensor is configured to measure and provide the information on at least one performance parameter from a group, comprising: fluid pressure from lire pump, current drawn by the motor, revolutions per time unit of the motor, torque supplied by the motor, power delivered and/or consumed by the motor, battery charge if the tool comprises a battery, rotational position of the motor, position and/or a movement of a piston in the work cylinder, approximation of an predetermined extension of the piston from the work cylinder, such as maximum and/or minimum extension, ambient temperature, fluid temperature, motor temperature, motor resistance, fluid resistance, controlled valve position, user and/or operator input, and the like. Additionally or alternatively the tool may further comprise at least one detector providing, to the controller, information for the controller to adapt at least one of the motor and the valve to the information, wherein the detector is configured to determine and provide the information on at least one parameter from a group, comprising: presence of the tool component and/or an extension thereof, connection to a mains power supply, water intrusion into the tool, a low battery level if the tool comprises a battery, and the like.

In an additional or alternative embodiment, the tool according to the present disclosure may be such, that the pump comprises at least two chambers and at least one controlled valve to selectively at least substantially block the input channel or open the bypass of at least one of the at least two chambers of the pump during at least parts of the respective suction or press halves of the piston cycle, in such an embodiment, the tool may be such that the controlled valve corresponds with more than one of the input channels or the bypasses to close off respectively open a maximum number of more than one fluid input channels or bypasses.

In an additional or alternative embodiment, the tool according to the present disclosure may further be such that the input channel comprises an input port to the chamber and the controlled valve comprises a moveable cover, configured to be selectively arranged onto or away from the input port. In such an embodiment having also a controller, the tool may further comprise a drive connected to the cover and under control of the controller, to selectively arrange the cover onto or away from the input port. Then, the tool may further comprise a transmission between the drive and the cover, configured to selectively move the moveable cover onto or away from the input port. When such a transmissions is provided, the tool may have at least two controlled valves each comprising a moveable cover, which are connected to the transmission and therethrough to the drive, which transmission and drive are common for the moveable covers. Then the tool may further also exhibit the features that the input ports of the plurality of chambers are aligned and the at least two moveable cover elements are on a carrier forming part of the transmission.

In an additional or alternative embodiment, the tool according to the present disclosure may further be such that the pump comprises a cylindrical pump house, in which the chambers are arranged. In such an embodiment with also aligned input ports, the tool may be such that the input channels of the chambers are one of radially and axially oriented in relation to the cylindrical pump house, wherein the carrier comprises a rotatable ring and the cover elements are arranged on the rotatable ring in an axial, respectively a radial orientation, to simultaneously block predetermined ones of input channels during the respective press halves of the piston cycles of the respective chambers.

In an additional or alternative embodiment, the tool according to the present disclosure may further be such that at least one of the chambers comprises an outward extending groove where the fluid input passage debouches into the chamber.

In an additional or alternative embodiment, the tool according to the present disclosure may further be such that a swivel plate is arranged on the pump shaft and connected to the pistons in the chambers of the pump. In such an embodiment, at least one of the pistons in the chambers of the pump may extend out of its chamber, wherein an end of the piston abutting the swivel plate comprises a protrusion extending outward relative to the chamber, for example a rounding, a cone, a truncated cone or a pyramid or a truncated pyramid shape, for optimal force alignment and piston guidance into or from the chamber.

In an additional or alternative embodiment, the tool according to the present disclosure may further be such that the pump and the motor are arranged on a common shaft comprising a common bearing of the shaft.

According to a further aspect of the present disclosure, a method is provided of operating a portable tool, capable of being moved by persons, users and/or operators. The tool can include a motor, and an actuable tool component connectable to the motor. The tool may also include an add-on from the group including an extension, a connection, and a fork, configured to be placed on the tool. The method may include determining presence of the add-on on the tool, and selectively increasing or reducing force and/or speed, depending on detected presence or absence of the add-on.

Following the above discussion of embodiments of tools according to the present disclosure in more generic terms, corresponding with features defined in the appended claims, herein below a more detailed description is provided, referring to the figures in the appended drawing. As indicated above, in particular, features of specific embodiments will be disclosed in order to provide a sufficient disclosure for the skilled person to comprehend, but none of fire specifically revealed features of particular embodiments should be interpreted as imposing any limitation whatsoever on the scope of protection for the assembly of embodiments according to the present disclosure, in as far as covered by—in particular—the independent claims of the appended set of claims. Moreover, in separate figures of the appended drawing, the same or similar aspects, elements, functionalities and components can be indicated using the same or similar reference numbers, evert though distinct embodiments may be involved. In the appended drawing:

Figure 1:
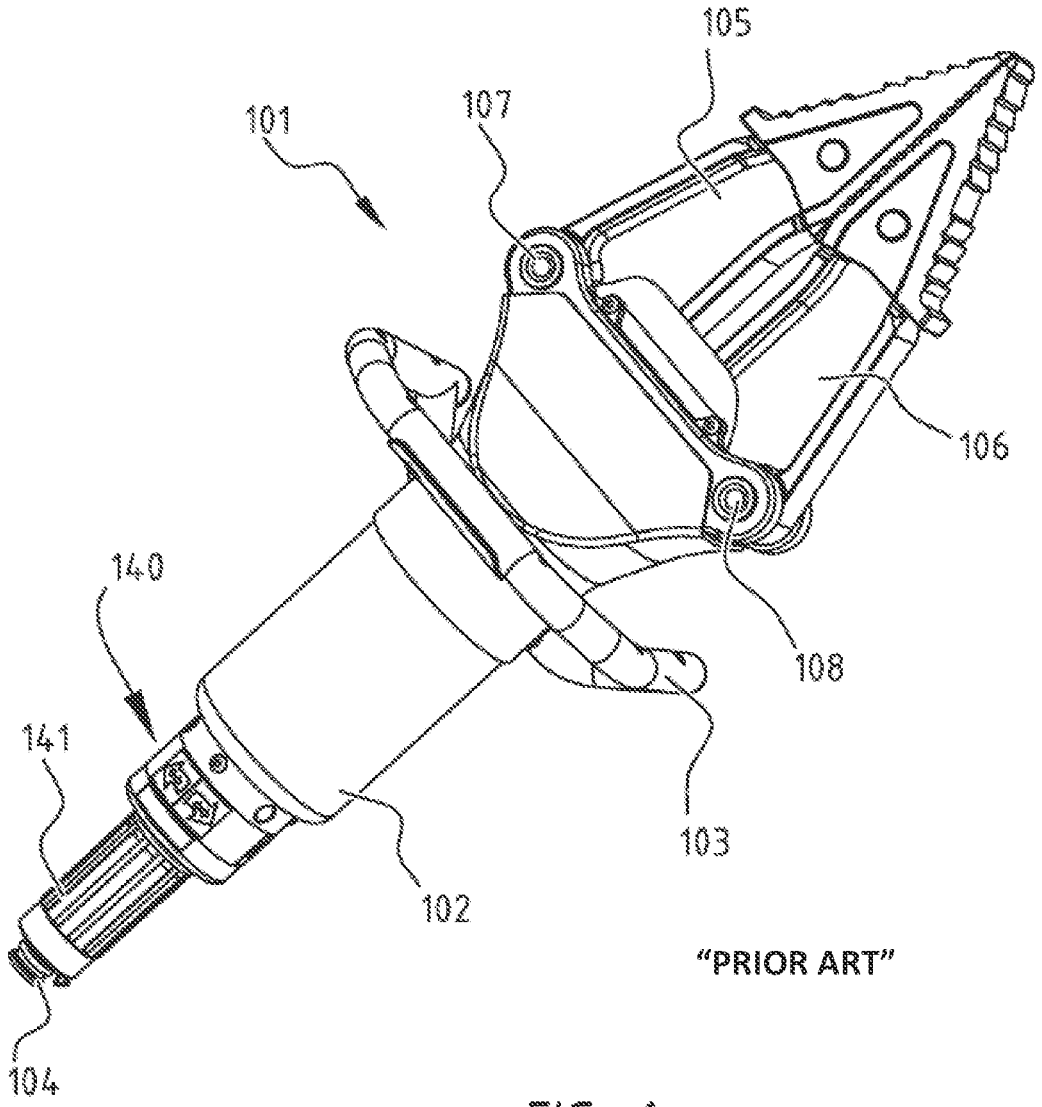
FIG. 1 shows a perspective view of a spreader as a potential embodiment of a rescue tool according to the present disclosure.
Figure 2:
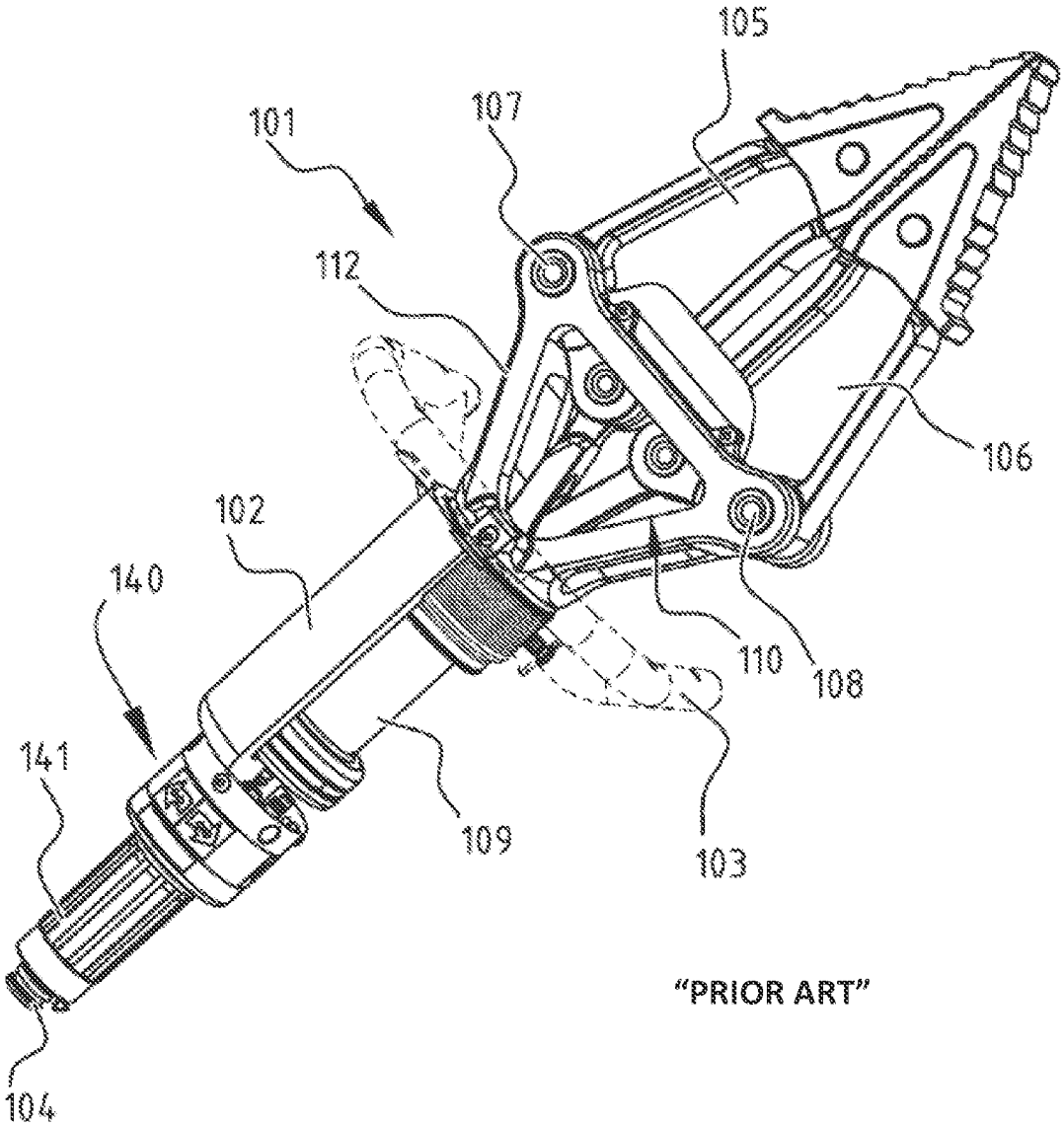
FIG. 2 shows a perspective view of the same spreader as in FIG. 1, but in a partially broken open representation.
Figure 9:
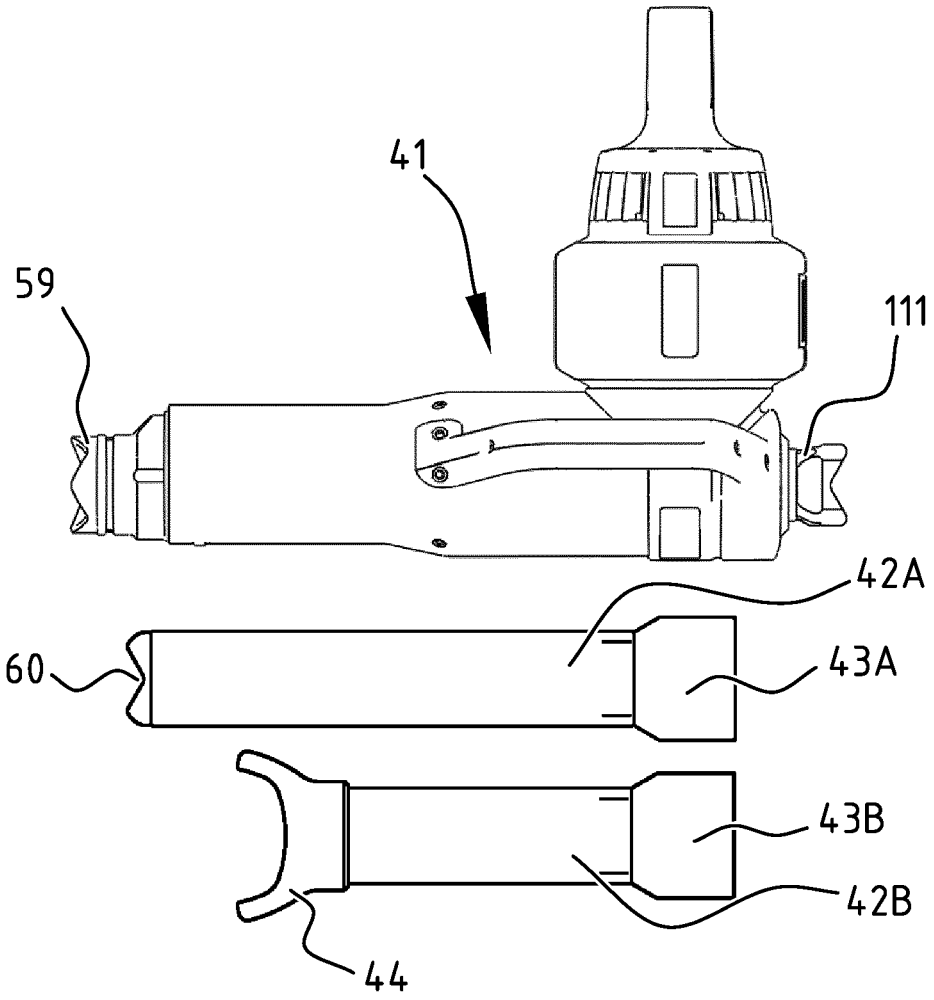
FIG. 9 shows a ram as an alternative embodiment of a tool according to the present disclosure, in conjunction with extensions that may be used on the ram.

In FIGS. 1 and 2, a known spreader 101 is shown. FIG. 9 shows a ram 41. Tools 101,41 are—merely by way of example—in the form of rescue tools, but could be any other type of hydraulic tool according to the present disclosure, and alternatively the present disclosure could also relate to a cutter, a ram such as the one in a below described figure, or the like. Principles of the present disclosure may also be applied in other tools than rescue tools, for example hydraulic power toots in general, where compactness may be desired, for example in the framework of the tool being portable and/or self-contained.

Spreader 101 comprises a spreader housing 102, optionally forming a structure of the spreader 101. The housing 102 is referred to as forming a structure in that thereby separate components may be connected. Spreader housing 102 accommodates a hydraulic work cylinder 109, and a connection to a hydraulic power source via connector 104 may then serve to drive cylinder 109, as for example in other embodiments than rescue tools, such as re-railing systems, synchronous lifting systems, skidding systems, demolition, recycling, and the like. Also for such tools, considerations underlying the present disclosure may apply, such as light weight and compactness, where it may be desired that system components may be lifted and moved by a single person. Preferably, though, for instance in embodiments of rescue tools, the tool is portable and/or even self-contained, as described in the below embodiments. Therein, the tool further comprises an integrated pump and associated electric motor, with a battery for powering the motor and a power supply for charging the battery. By providing a description of working principles of an exemplary spreader 101 as an embodiment of a tool according to the present disclosure, the basis is laid for the below embodiment description of embodiments with more explicitly disclosed there the distinguishing features according to the appended claims of the present disclosure.

Figure 3:
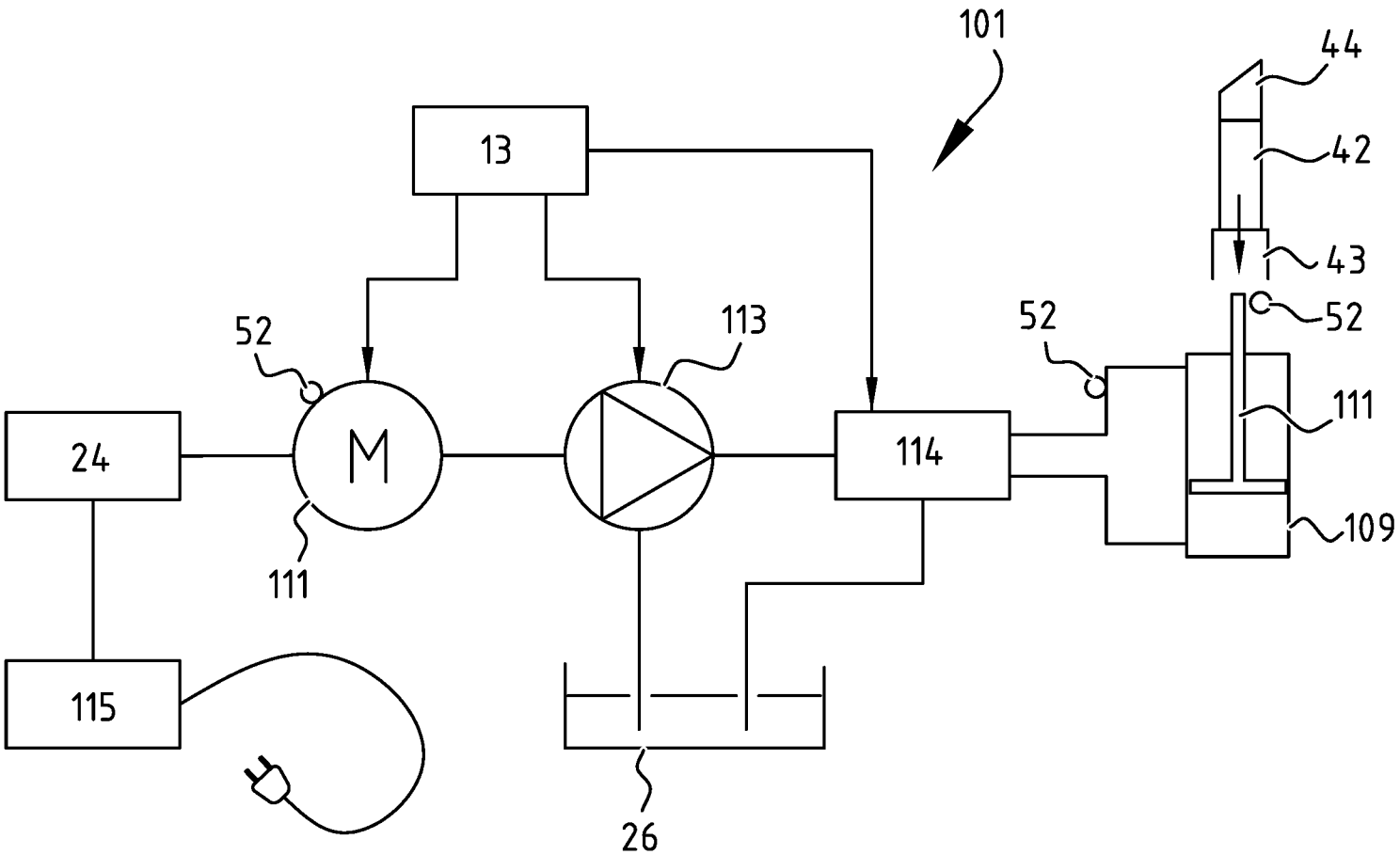
FIG. 3 shows an schematic representation of a tool and control thereof according to the present disclosure.
Figure 4:
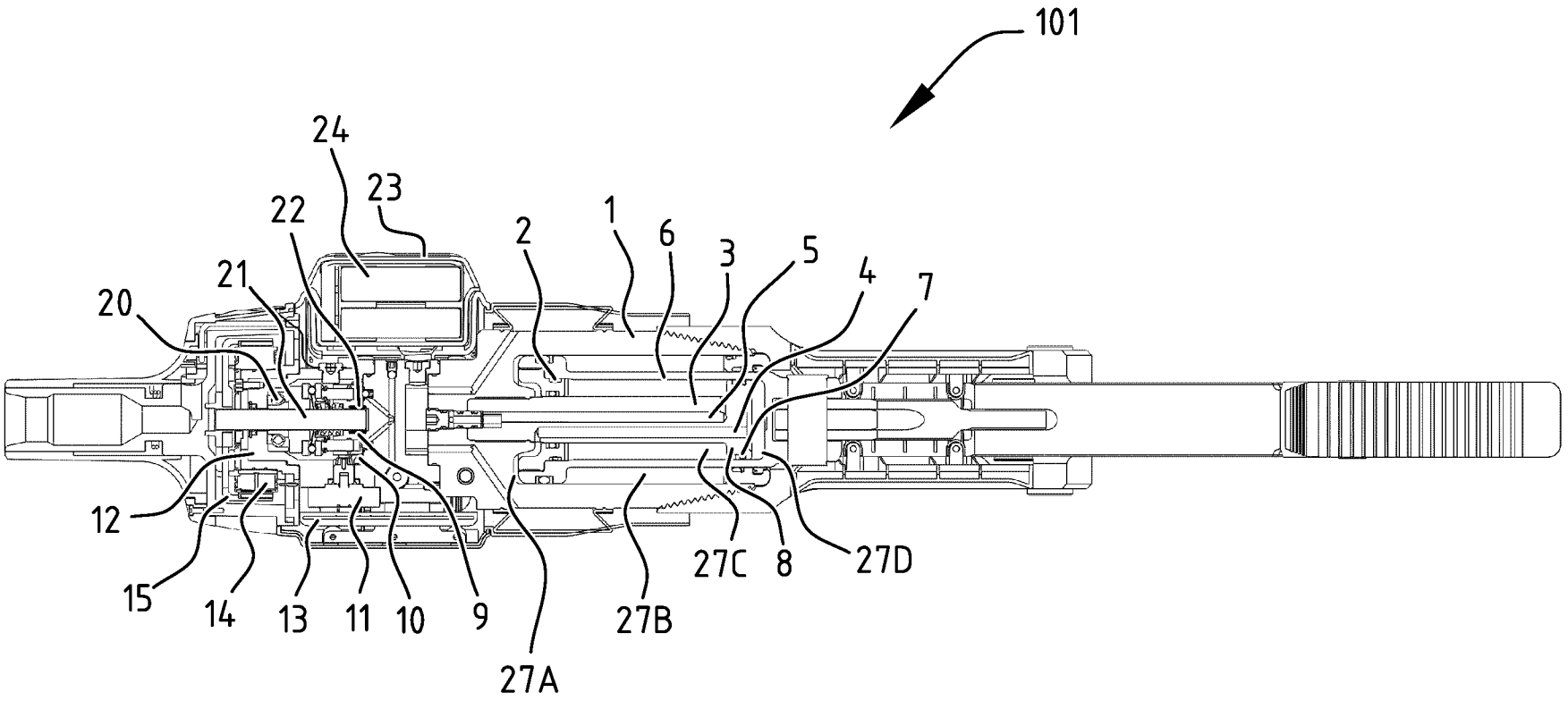
FIG. 4 shows a more detailed embodiment of a tool according to the present disclosure.

Extending out of work cylinder 109 is a piston rod 111, which is not visible in FIGS. 1 and 2 but shown in FIG. 3. Piston rod 111 is connected via a transmission 110 to two rotatably drivable arms 105, and 106, which are rotatably connected to a yoke 112 in rotation points 107, and 308.

When work cylinder 109 is driven to extend its piston rod 111, then transmission 110 pushes arms 105 and 106 out, which are in the exhibited configuration thereby driven to swivel outward relative to rotation points 107, and 108 on yoke 112, and force apart any external elements, such as parts of a car wreck. Evidently a different transmission may be deployed when the tool is another type of rescue tool, such as a cutter, in which the driveable arms 105, and 106 are replaced by cutter blades and driven to be forced together and cut portions of a car wreck. Such cutter blades, drive arms 105, and 106 and/or other elements of a tool, to form actuable tool components that may be connected to piston rod 111 of work cylinder 109.

As shown in FIG. 3, the tool may comprise a pump 113 connected to work cylinder 109 or cylinder 1 in subsequent figures via a valve block 114 configured to set the direction of fluid flows to an upper or lower chamber of the cylinder 1, 109 and/or to the tank or reservoir 26. A controller 13 provides control signals for the valve block 114, pump 113 and a motor 111. The motor 111 comprises a stator 14 and a rotor 15, where the motor 111 is electrically connected with a battery 24 and mechanically with pump 113. The battery may be charged via a charger circuit 115, and pump 113 may be reversible. Even if fluid under pressure is externally supplied or pumped off from work cylinder 1, 109, or provided by a pump and motor assembly internal of the tool, the tool may comprise controller 13 to control at least one of motor 111 and the pump 113 and/or control the work cylinder 1, 109 via valve block 114. In the schematic embodiment of FIG. 3, the controller 13 controls valve block 114 to open or close a selection of connections to cylinder 1, 109 and to tank or reservoir 26, depending on a desired one of the plurality of distinct extension or retraction force levels, and a selection of a desired one of the force levels may depend on a large number of possible internal or external circumstances.

Tool 101 may comprise a plurality of sensors 52 connected to controller 13, to provide information, based on which the controller 13 may adapt at least the motor 111 and/or pump 113 and/or the valve block 114 to the information. In such an embodiment, any one of the sensors 52 may be configured to measure and provide the information on at least one performance parameter from a group, comprising: fluid pressure from the pump, current drawn by the motor, revolutions per time unit of the motor, torque supplied by the motor, power delivered and/or consumed by the motor, battery charge if the tool comprises a battery, rotational position of the motor, position of piston 6, 111 in work cylinder 1, 109, approximation of a maximum extension of piston 6, 111 from work cylinder 1, 109, ambient temperature, fluid temperature, motor temperature, motor resistance, fluid resistance, presence of the tool component 105, 106, presence of an extension 42 thereof, connection to a mains power supply, water intrusion into the tool, a low battery level if the tool comprises a battery, and the like.

These and other internal and internal circumstances, parameters and determinations allow the controller 13 to optimize a selected force level adapted to the internal state of tool 101 or to external circumstances. For example, if the motor 111 is beginning to overheat, selecting a lower force level may allow the ongoing work to be continued and even finished at a lower force and/or pace. For example, the present disclosure allows the deployment of less pump chambers (as disclosed below) by corresponding control of the controller 13 over the pump 113, allowing torque provided and heat generated by the motor to be lowered. Thus the level of generated force may be maintained, while speed may be reduced.

As a further example of possible functionality according to the present disclosure, when the piston 6, 111 approximates full extension, the controller 13 may reduce extension force to a lower level and even nill at the maximum extension, to avoid damage to the work cylinder 1, 109 or other internal or external components. The maximum extent of the piston 6, 111 may be influenced by an extension 42, connection 43 and/or fork 44 on or instead of the actuable tool component 105, 106, in case of for example a ram. Extension 42 may even communicate its presence to the processor through a signal over a wire or wirelessly. The controller 13 may then take the extended length of the tool into account for increasing or reducing force and/or speed, for example when an additionally provided sensor on the extension 42 indicates an approaching boundary of a movement range at an obstacle, for example a beam or post of a car wreck. Once abutment is realized, the force may again be increased. It is noted that such embodiments with smart extensions proclaiming their presence on a tool, or even additional sensors on such an extension, for example a proximity sensor, are all to be considered inventions in their own right, even without features of the appended independent claim; for example without the hydraulics and using a spindle drive or other type of drive, instead of the pump and cylinder combination.

As shown in FIGS. 1 and 2, connector 104 may comprise a handle 141 with user input elements 140, for example to reverse a motion direction of the actuable tool component 105, 106. Additionally, the handle 141 may be rotatable, which may be detected using a sensor, to enable the user/operator to increase speed or force, by rotating handle 141 left or right. Consequently, the function of the tool may be actively operated by the user, where the controller 13 will allow the settings input by the user, unless internal or external circumstances restrict the possibilities of setting the tool, for example to protect the tool 101 from damage or malfunction. For example, when user/operator input is received to increase speed or force, but the motor is approaching a limit of acceptable temperature, the user input for more force may be ignored or superseded by the controller 13.

Evidently, the present invention allows for a degree of automatic and user input control of tool 101 and 41 that was unimaginable before the present disclosure.

The spreader 101 comprises, according to the more detailed view in FIG. 4-8, where the same principles may apply to the ram 41 of FIG. 9, cylinder 1, having seal 2, more in particular a dynamic seal, where cylinder rod 3 is retracted in cylinder 1. Pressure line 4 extends through rod 3 to debouche in a chamber in front of head 8 connected to rod 3, while a further pressure line 5 debouches in a further chamber within cylinder 1 behind head 8, with the chambers divided by the head 8 and a seal 7 surrounding head 8.

Cylinder piston 6 may respectively be driven in a retracting movement and a driven advancing movement, depending on the supply of pressurized fluid.

Cylinder 1 is supplied with pressurized fluid from a pump having a cylindrical pump piston housing 9, forming part of pump house 12, with the pump piston housing defining chambers, in each of which a pump piston 28, 50 (shown in more detail in following figures, for example FIG. 5) is arranged. The chambers extend axially, with the pump pistons 28, 50 axially and cyclically movable therein, while input or suction ports 30 for supply of hydraulic fluid to individual chambers extend radially relative to the cylindrical pump piston housing 9. Where a pump piston 28, 50 moves past the suction port 30 in a forward or press half of a cycle thereon, the pump piston 28, 50 itself acts as a non-return valve to ensure that fluid is not pressed back out through suction port 30 to reservoir 26. To ensure proper filling of the chambers, with the pistons 28, 50 in a retracted position, the chambers are provided with an annular suction groove 29.

Figure 7:
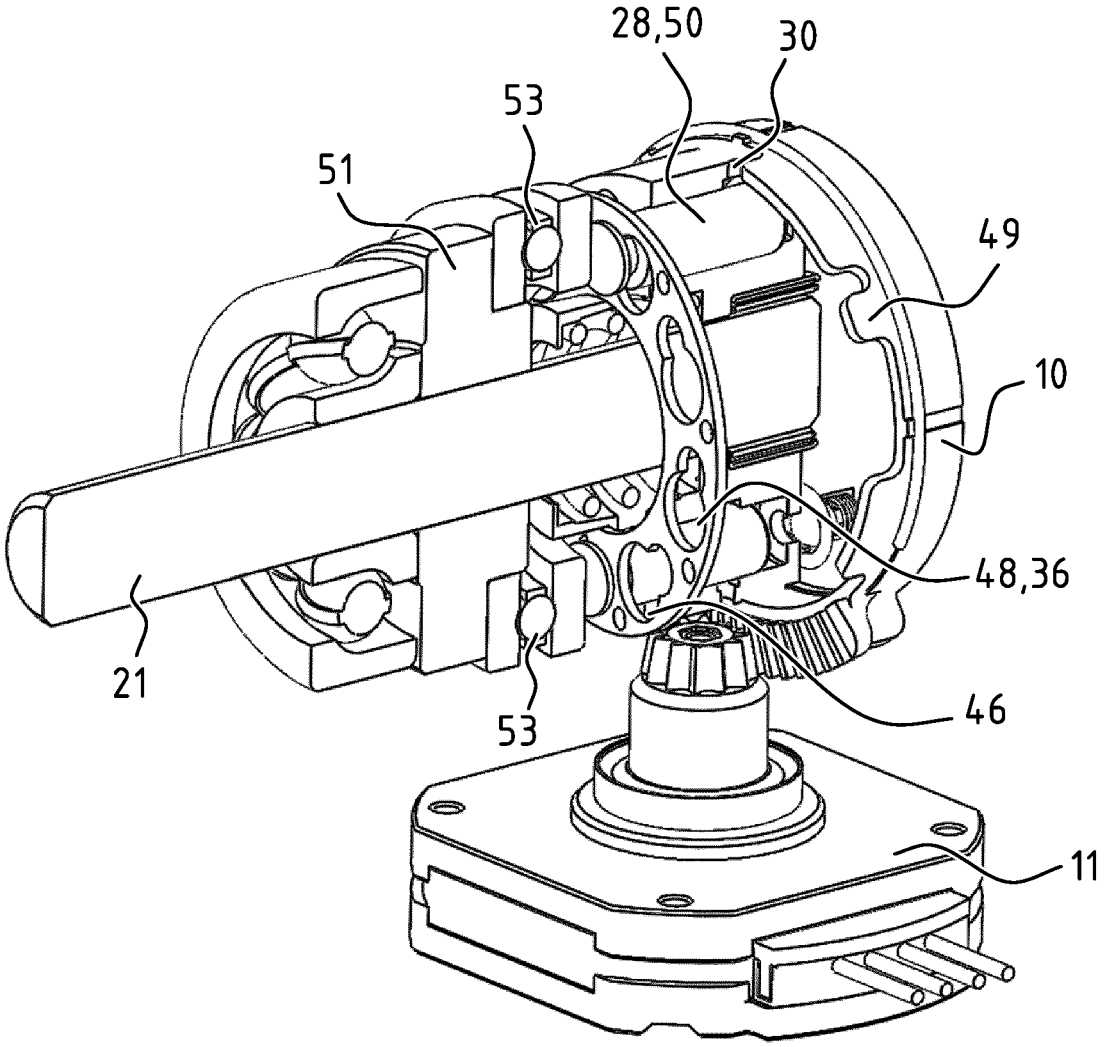
FIG. 7 shows a configuration of the arrangement of the pump on the shaft of FIGS. 5 and 6 with a controlled valve for allowing distinct chambers of the pump to be involved in feeding pressurized fluid to the cylinder.

Surrounding pump piston housing 9 of pump housing 12, stage ring 10 is provided. As shown in FIG. 7, stage ring 10 is rotatable around pump piston housing 9, with closing flaps, lips or covers 49 thereon, acting as controlled valves to inhibit intake of fluid into a selection of the plurality of chambers in a low pressure suction half of cycles of the pump pistons 28, 50. Since the pump pistons 28, 50 themselves act as heavy duty non-return valves to avoid fluid being pressed hack into reservoir 26, controlled valves 49 may be embodied very light and simple, for example as flexible lips 49 on stage ring 10. The lips are distributed along the periphery of stage ring 10, so that a predetermined number of chambers are or are not contributing to supply of pressurized fluid to the cylinder 1. To this end, stage ring 10 may be rotated around pump piston housing 9, to close or open a predetermined number of suction ports 30. A stage motor 11 is provided to determine a position of stage ring 10 and more in particular lips 49, to cover a desired number of ports 30, and omit contributions therefrom to the output of pressurized fluid to the cylinder 1, under control of the controller 13. The controller 13 may determine which and how many chambers are to contribute at any given time, depending on a number of internal or external considerations and measurements. Based thereon, controller 13 may control stage motor 11 to position stage ring 10 and lips 49 thereof over the desired ones and number thereof of the suction ports 30. The controller 13 may receive input to this end from a plurality of possible sensors and detectors 52, allowing an enormous automatic control over the tool as well as enabling useful user input.

Pistons 28, 50 of the pump in pump piston housing 9 are driven by a motor comprising motor stator 14 and motor rotor 15, where the motor is arranged on common shaft 21 with the pump 113, where the pump 113 and motor 14, 15 are arranged directly adjacent relative to one another on the common singular shaft 21. Consequently, the common shaft 21 is singular, i.e. a one-piece component without any intervening coupling or transmission, and the pump and motor are arranged thereon in a side-by-side configuration. The pump is also arranged on shaft 21, which allows for a compact design. Shaft 21 is arranged in a set of bearings 20, 22. A swivel plate 51, which backs a pivot bearing of which bearing balls are arranged in a carrier plate 53, is arranged on shaft 21 to—when shaft 21 is rotated by motor 14, 15—sequentially drive the pump pistons 28, 50 in the cyclical movements thereof through a suction half and a press half of their cycles, which, because of the axial configuration of the pump's chambers, are sequential.

Figure 5:
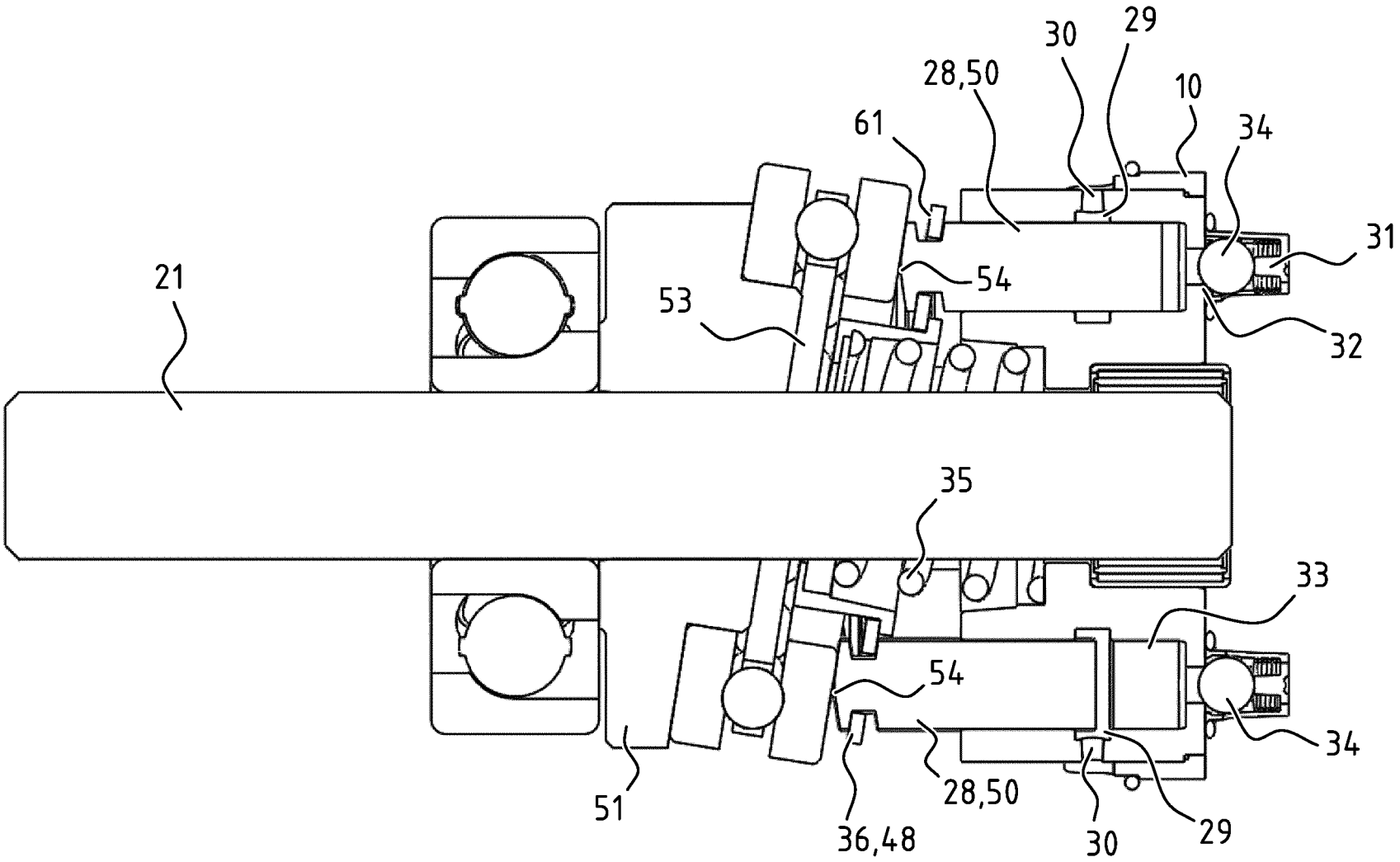
FIGS. 5 and 6 show in more detail a configuration of the pump being arranged on a common motor and pump shaft in the tool of FIG. 4.
Figure 6:
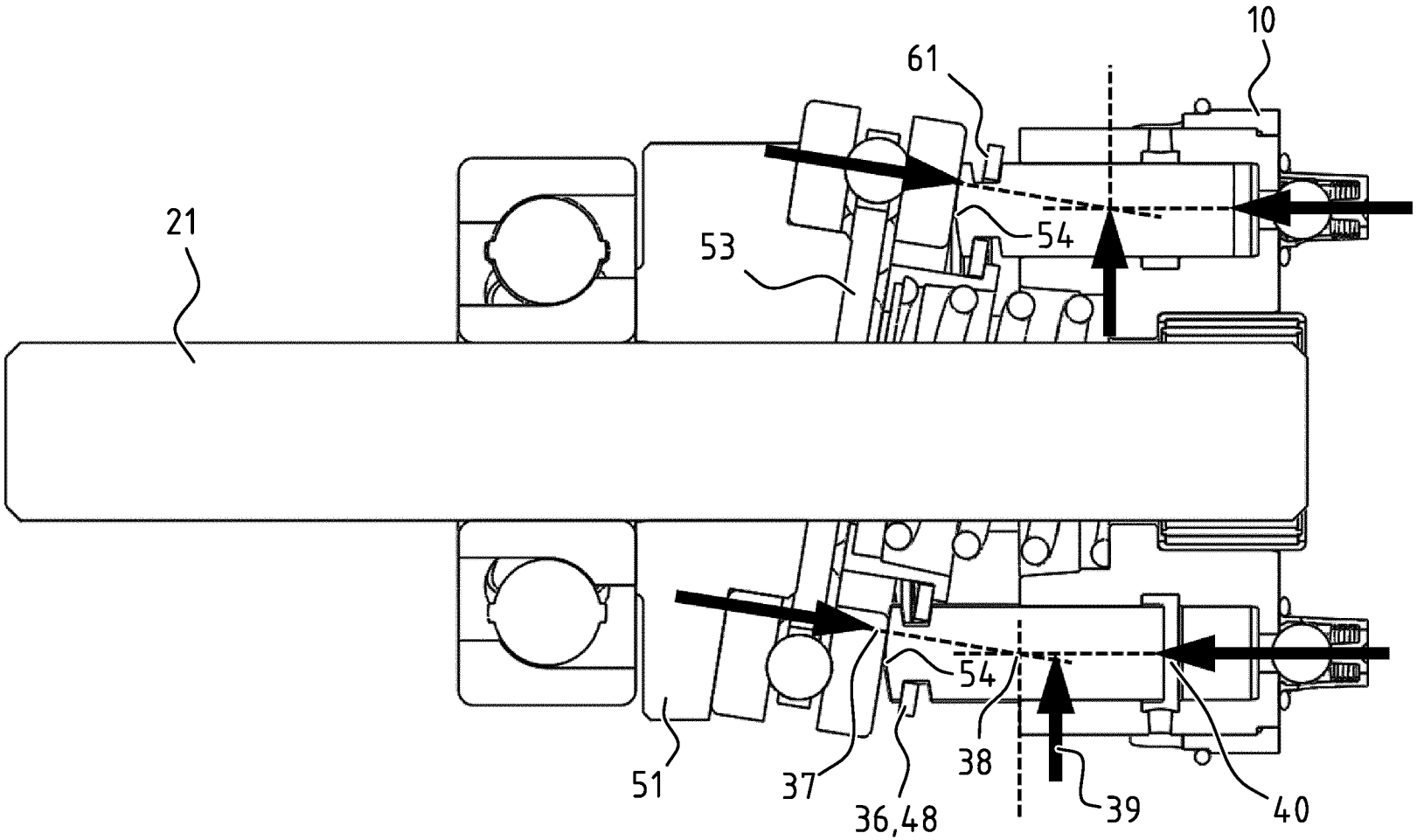

As shown in FIGS. 5-7, pump pistons 28, 50 have a rounded head 54 and a constriction 61 for coupling with piston holding plate 36, 48 in groove holes 47. The heads 54 of the pistons 28, 50 may have alternative shapes, such as conical, frusto-conical, pyramidal, frusto-pyramidal, and the like. In particular, the shape of the heads 54 of the pistons 28, 50 may be conical with a rounded, bellowed or slightly bulging shape. In relation to FIG. 6, it is noted that the angle of force impingement, when the swivel plate 51 rotates with the shaft 21 under influence of the motor 14, 15, an optimal force transfer is achieved along force vector 37 via interaction point 38 with the resulting force vector identified with arrow 39, to achieve the fluid force vector 40. As a consequence of the shape of the heads 54 of the pistons 28, 50, a radial component of applied force is, at the interaction point 38, within chamber 33 to allow optimal guiding of the pistons 28, 50 therein. In embodiments of shapes of heads 54 wherein the interaction point is outside the chambers 33, the length of pistons 28, 50 must be increased to withstand a tilting effect caused thereby. Swivel plate 51 consequently rolls over or follows contours of the rounded heads 54 of pistons 28, 50. Thereby, practically all of the force exerted by the motor 14, 15 via swivel plate 51 on the pump pistons 28, 50 is transformed in a rectilinear force in the direction of the cyclical movement of the pistons 28, 50.

The shaft 21 may optionally be additionally linked with a fan (not shown) to drive an air flow through the tool. The air flow thus generated may assist in cooling of the tool. In such an embodiment, an air inlet, an air flow path along the fan and an air outlet will need to be provided. However, in such an embodiment a risk may exist of penetration of fluid or at least humidity, for which a sensor 52 may be provided to determine the fluid/humidity level and allow the controller 13 to adjust the workings of the tools on the basis of detected fluid/humidity levels. Also a filter may then be provided to inhibit intrusion of particles into the tool, which could hamper cooling, if clogging an air flow path through the tool along the fan.

In the embodiment of FIGS. 5, 6 output ports of chambers 33 lead to a check or non-return valve 31, comprising a spring loaded ball 34 in a seat 32, which is pressed out of seat 32 during the press half of the piston cycles by fluid expelled from chambers 33 by pistons 28, 50.

Spring 35 is arranged around shaft 21, between a seat of its own and carrier plate 53 or piston holding plate 36, 48, with the carrier plate 53 holding bearing balls of pivot bearing between the pivot plate 51 and pistons 28, 50, to press carrier plate 53 towards swivel plate 51. Piston holding plate 36, 48 may be attached to the carrier plate 53.

Figure 8:
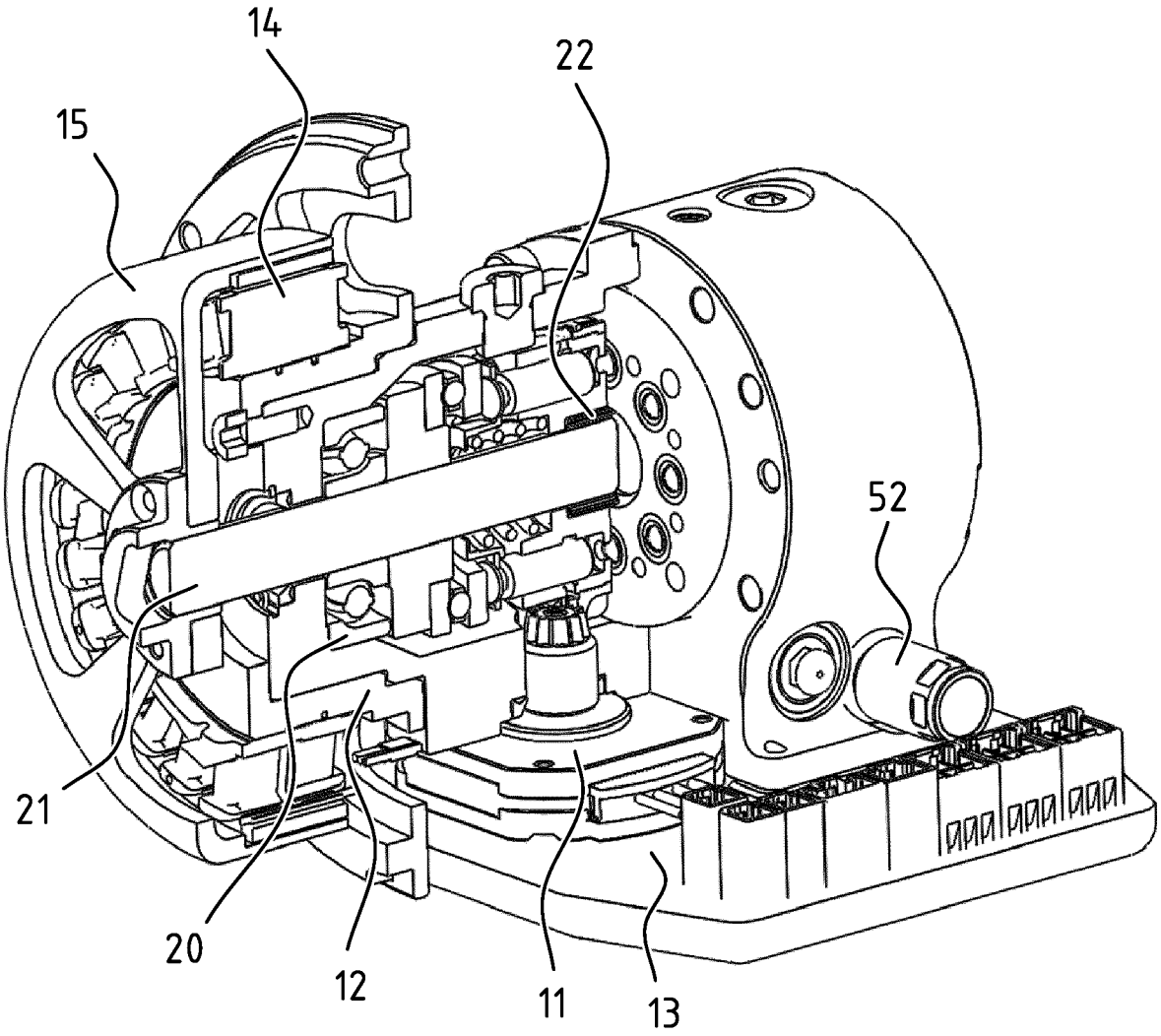
FIG. 8 shows a similar embodiment as FIG. 7 but with more and other components.
Figure 10:
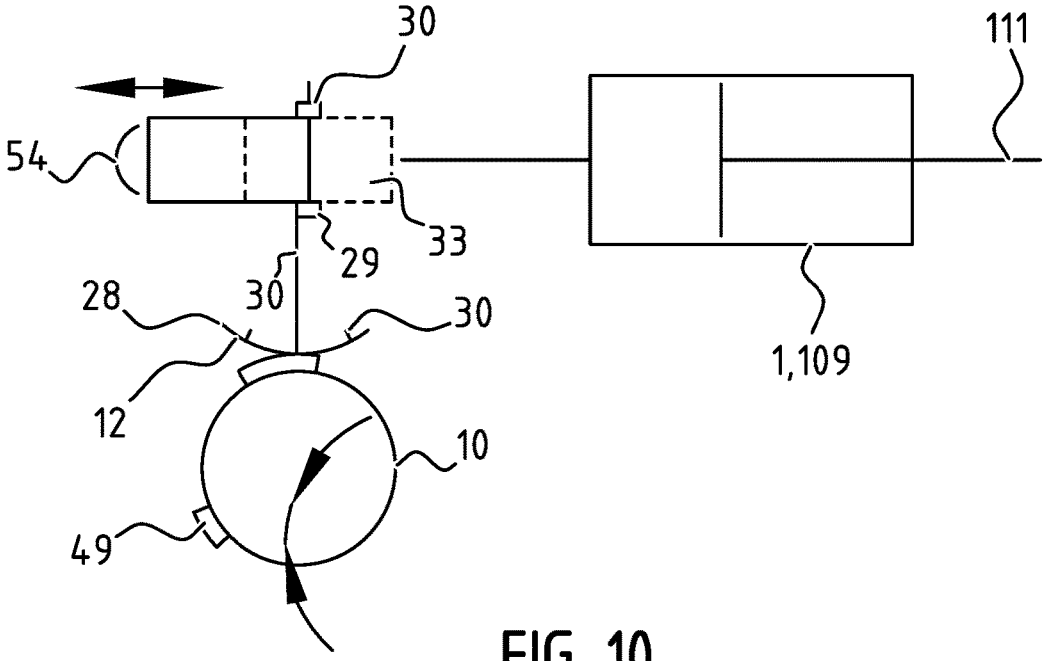
FIGS. 10 and 11 show mutually different embodiments to avoid a controlled valve from having to be a heavy duty valve for closing valve of the output port.

FIGS. 7, 8 and 10 show the working of the compact motor 14, 15 plus pump configuration on common shaft 21, in schematic and partially open representation.

The piston holding plate 36, 48 is attached to the carrier plate 53, and docs not rotate with shaft 21, while swivel plate 51 is fixed to and rotates with shaft 21. For the configuration of FIGS. 7, 8, 10, swivel plate 51 is arranged on shaft 21 to rotate therewith. If the swivel plate 51 has a front surface with a circumferentially waved or curved surface, this allows for a transfer rate of the rpm of the motor 14, 15 to the cycles of the pistons, of for example ratio two, when the front surface of the swivel plate 51 has two protrusions to the from (towards the pistons 28, 50) and two backward recesses. However, in a simpler embodiment, the swivel plate 51 comprises a single sinusoidal period, i.e. one protrusion and one recess in the front surface facing the pistons 28, 50, in one full circumferential pass along the front surface. The latter embodiment is shown in the appended figures, which has for a net result a front surface of swivel plate 51 facing the pistons 28, 50, that is planar and oblique relative to the longitudinal axis of the shaft 21.

The stage ring 10 carries tips or cover elements 49, to cover the suction input port 30 of at least one chamber, depending on the position of ring 10. This position is determined by the controller 13, and set under control of the controller 13 via stage motor 11. Any number of internal and external sensors, like sensor 52, determining fluid input of the ports 30 and consequently pressure and fluid flow output by the pump, and additionally user inputs 140, 141, may provide a basis for the controller 13 to determine the position of the stage ring 10 and therewith determine the number contributing chambers 33, to contribute to the output of the pump, by positioning the lips or cover elements over ports 30 of the determined number of chambers that are not to contribute. Depending on versatility of the stage ring or an alternative embodiment of controlled valves, individual chambers may be designated to contribute—or not—and then an even distribution of contributing chambers along the circumference of the pump piston housing 9 may be realized, to also evenly distribute forces and loads therein. Positioning of the lips or cover elements 49 on the stage ring 10 relative to the ports 30 of the chambers may be optimized in this respect. Single lips may cover more than one of ports 30 of a plurality of chambers.

Consequently, a compact configuration is achieved by the common shaft 21, and by the simplest of measures to determine how many or even which particular ones of the chambers 33 contribute to the output of the pump, without having to deploy heavy valves to shut of the output ports 30, against the pressure in the output ports, if the simple input closing lips or cover elements 49 were replaced by such valves on the output ports.

Figure 11:
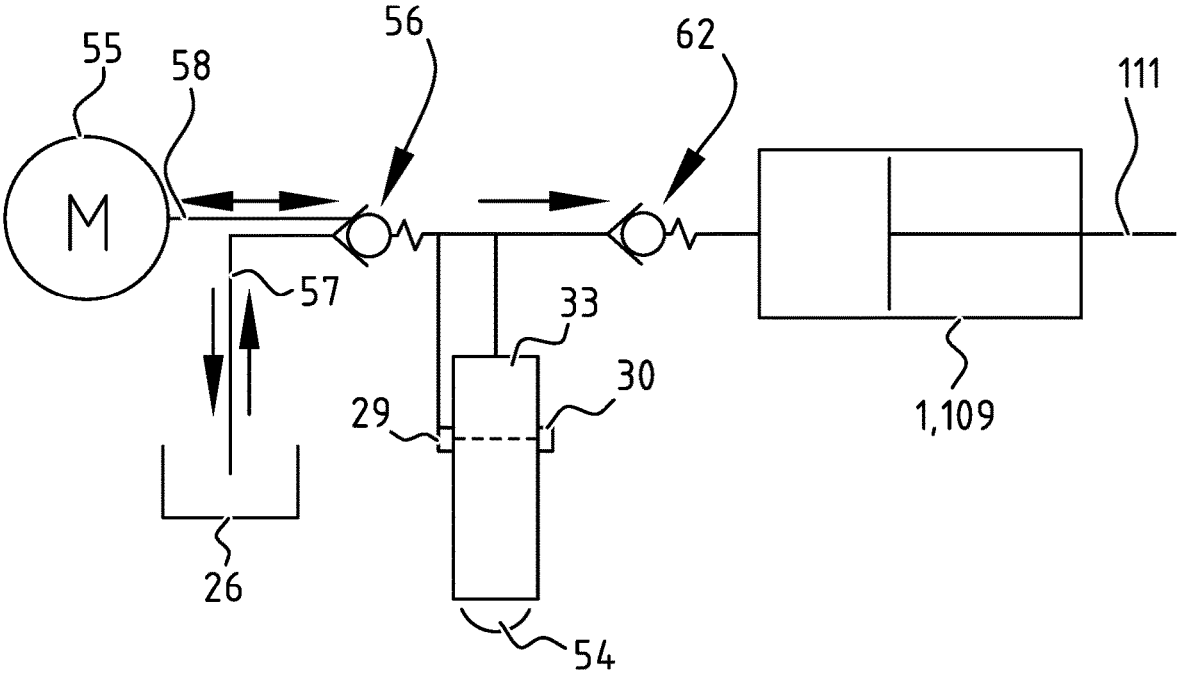

An alternative configuration for the same purpose is generally indicated in FIG. 11. Therein, motor 55 is configured to, under control of controller 13, extend a pin 58 to forcibly open a check or non-return valve 56 in a bypass 57 from the output port of a chamber 33 of the pump to the reservoir 26, to prevent the flow of fluid from the chamber 33 to be directed to the cylinder 1, 109, and then not contribute to the total output of the pump, and still avoid a heavy duty valve on the output port to achieve the same purpose. It is further noted that heavy duty valves between the output port of chambers of the pump and the cylinder 1, 109 are not excluded from the scope of the present disclosure according to at least some of the appended and even independent claims.

In the embodiment of FIG. 11, chamber 33 draws in fluid from reservoir 26 along the same bypass channel 57 in the suction half of the cycle of piston 28, 50, opening the check or non-return valve based on the suction force of piston 28, 50. Alternatively, a parallel channel may be provided from the reservoir 26 to the chamber 33.

A further check or non-return valve 62 is preferably arranged in the channel between the chamber 33 and the cylinder 1, 109. This check or non-return valve may also be provided in the embodiment of FIG. 10.

Referring back to FIG. 4, tool 101 comprises a battery housing 23 to contain a number of battery cells 24. The housing 23 and cells 24 may surround cylinder 1, and likewise reservoir 26 may surround cylinder 1 for reason of a compact configuration, as well as for heat transfer away from the motor 14, 15 and the cylinder 1, 109. Therefore, the reservoir 26 and fluid hydraulic therein, such as hydraulic oil, may contribute, in such an embodiment, to distribution over the tool and dissipation of heat generated by the motor and/or the pump, allowing a longer effective duration of deployment. Additionally or alternatively, a heat sink may be provided, to preferably also surround the cylinder 1, 109.

In the above described embodiment, the total cylinder volume has a number of components 27. These allow the necessary extension/contraction of the rod 111 into and out of the cylinder 1, 109, by appropriate driving via controller 13.

FIG. 9 shows a ram 41, as an alternative type of tool in which the present disclosure may be useful. The ram 41 may be equipped with any one of a number of extensions 42A, 42B on the piston rod 111 of the cylinder, or on a back stud 59. For arranging one of extensions 42A, 42B on piston rod 111 or on back stud 59, both extensions 42A, 42B have a connector 43A, 43B. Extensions 42A, 42B have differing lengths, and the shorter extension 42B has a fork 44 instead of a stud 60 of a further stud 60 of longer extension 42A. A sensor may be provided to detect the presence of any one of extensions 42A, 42B on rod 111 or on stud 59. Extension 42A or 42B may have a wired or wireless means of communication to announce its presence to the tool 41, and in particular to the controller 13 thereof. This presence or absence of any extension may cause a different operation mode, selected and set by controller 13, as would the pressure detected by pressure sensor 52 on the output side of the pump.

The present disclosure allows a hydraulic tool to gear up or down, depending on internal or external circumstances and/or user inputs. For example, a load may be measured to determine whether to gear up or down the tool. To this end the controller 13 may adapt the motor's rpm's and adapt the number of pump chambers to contribute to the total pump output, to select for speed and/or for power and/or generated force. Other circumstances may also be taken into account, such as motor temperature, to gear down the tool, when it is detected the motor is overheating, but by gearing down, operations may be continued and the motor may be protected against a burn out as an example of internal circumstances. Any number of sensors and detectors may be used, like the pressure sensor 52 for determining the pump's output pressure, for the controller to adapt the operational state of the motor and/or pump, including user input.

In a tool, in which gearing up or down is not possible, as in the prior art hose connected tools, the transmission rate is to be selected such that at the highest anticipated cylinder force, the designed motor torque is sufficient and will not be exceeded. A tool then results, that may not be able to also provide to desired speed, comparable with a car having only a first gear.

According to the present disclosure, internal and external circumstances are taken into account as well as allowing user input, to adapt the mode of the tool in terms of gearing up or down, while preferably avoiding but not excluding large, heavy duty closing valves on output sides of a plurality of chambers. By employing a suction side closing valve and/or an output side bypass (such as the controllable valve 56 in in the embodiment of FIG. 11) for each of a plurality of chambers, low weight, low volume, efficient gearing may be furnished.

In the embodiments with controlled valves for closing input ports of a selection of a plurality of pump chambers during the suction half of the piston movement, separate from a normal valve for closing the input port during a press half of piston cycles of pistons in chambers of the pump, the lid or covers do not even need to fully close the input ports but may merely restrict inflow into the chambers of fluid. A flexible flap, lip 49 or the like suffices. The stage ring 10 carrying the cover elements, or lips 49, can therefore be realized simply and cheaply. Stage motor 11 also needs only to be very cheap and simple, robust and small sized.

Figure 12:
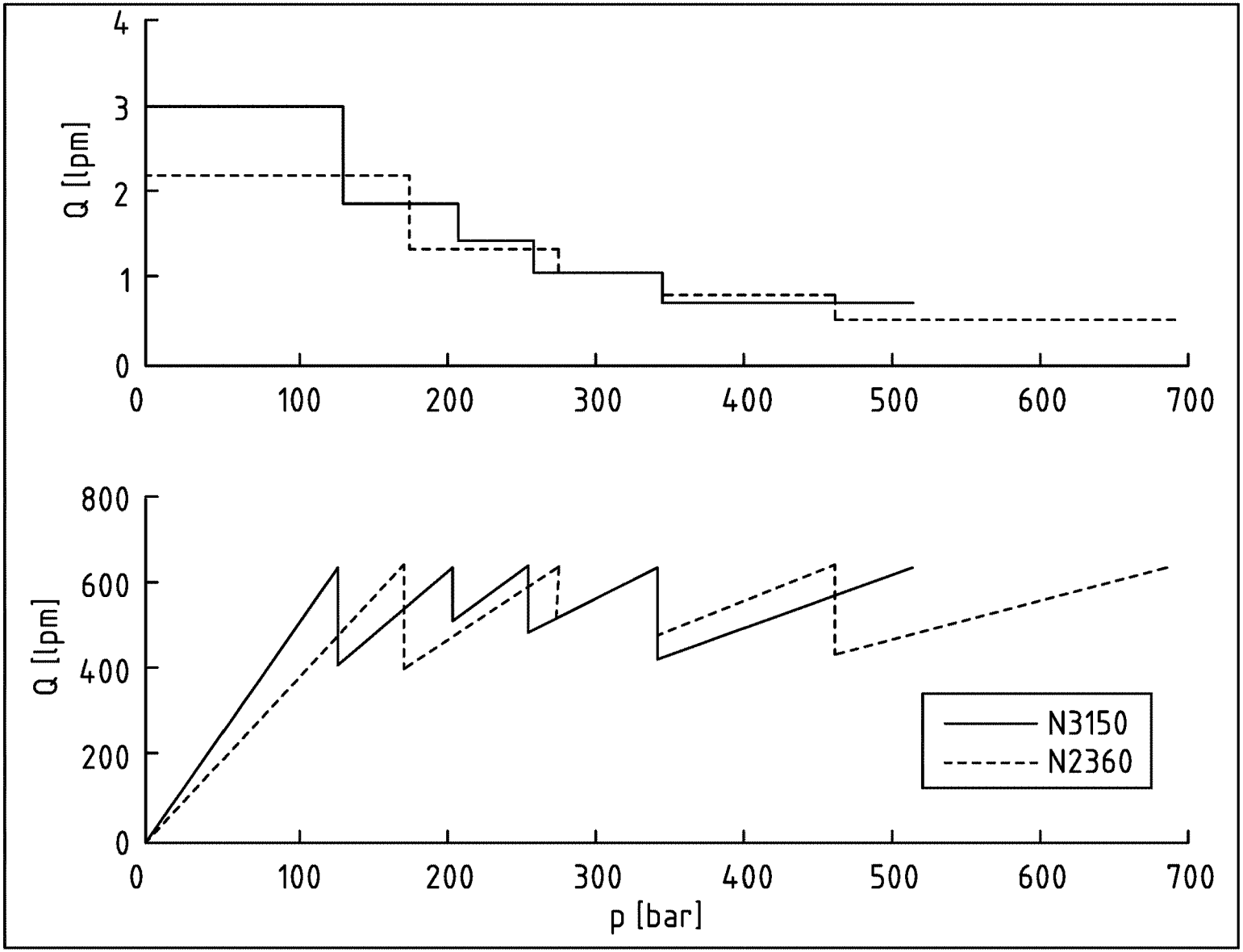
FIG. 12 shows ramping characteristics of a tool according to the present disclosure.

With the principles of the present disclosure, a graphic representation of ramping up the tool according to FIG. 12 may be provided. This allows taking both speed and generated force into account, while miniaturization of the tool can be achieved, also through the common motor and pump shaft 21, where work volumes from the pump may be adapted under control of possibly also the motor, to internal and external circumstances, as well as possibly user input.

The uppermost graph of FIG. 12 exhibits flow Q in liters per minute (lpm) against pressure p in bar from the pump, which is directly related to extension speed of the piston 111 from cylinder 1, 109. The lowermost graph exemplifies motor power P in Watt against pressure p in bar. The exemplified graphs relate to a pump having four stages with eight chambers 33. For any stage a required number and possibly even an individual selection of contributing chambers 33 is deployed, and remaining chambers do not contribute, in the sense that these non-contributing chambers are either by-passed as in FIG. 11, or an input (suction) port thereof is closed off. In this sense, the non-contributing chambers 33 can be referred to as "switched off". It is evident that controller 13 of the four stage pump can add or reduce the number of contributing chambers 33, by controlling the controlled valves 49 or 56, for each of the chambers 33. This enables the motor power P to be kept at a level under an allowable maximum value, even while consecutively raising or lowering pressure p as in the lowermost graph of FIG. 12 and speed related to volume Q as in the uppermost graph of FIG. 12, by stepwise selectively adding or omitting contributing chambers 33. The controller 13 may gear down or down the pump in the direction of increasing or lowering pressure p or speed and volume Q, by following a solid line or dashed line characteristic in FIG. 12, the controller is able of determining a most suitable characteristic on the basis of measured or detected internal or external circumstances.

The controller 13 is configured to take internal and external circumstances and considerations for switching the number of contributing chambers 33. Such circumstances may be determined based on signals from performance sensors or detectors 52, as well as user or operator input via switches 140 and/or rotating handle 141, and the like.

Additionally or alternatively, the controller 13 may be capable of adapting switch pressures between stages, as shown in FIG. 12, which is exemplified by the characteristic graphs in dashed lines as an alternative for switching in accordance with the solid line.

To avoid excessive load of motor 55, 111, torque delivered by the motor 55, 111 and battery current from battery cells 24—if provided on board of the tool—needs to be limited. The controller 13 provides for electronic speed control, herein below also referred to as "ESC", based on the characteristic graphs of FIG. 12 for a particular embodiment of the present invention in conjunction with measurement or detection results and/or user/operator input. This allows the motor power to be kept below a maximum, while going through the four stages of the lowermost graph in FIG. 12, which in turn allows a simpler, lighter, compacter and lower power motor to be used, than if a one-stage pump were to have to build up the pressure for the work cylinder.

The controller 13 may be provided with data from sensors 52 providing information on motor torque and battery current to the motor, and is then already capable—even without information from any pressure sensors 52, if provided—to control any of controlled valves 49, 56 to adapt the gearing to these parameters, by adding or omitting contributing chambers 33, based on a desired one of the graphs in FIG. 12.

Here it is noted that motor torque corresponds linearly with motor current and a voltage sensor 52 may measure motor voltage, where the controller 13 may be able to determine, from the determined motor voltage and motor current, (remaining) battery capacity, and when also the battery voltage is monitored, the battery current can further also be deduced.

Combined control by controller 13 of the motor 55, 111 and the (stage motor 11 driving the) controlled valve 49 or 56, for example to set the position of the stage ring 10, offers a host of entirely new and beneficial functionalities.

Control of the motor speed in rpm, motor torque and ratios as in FIG. 12 can be optimized for maximum power and/or efficiency.

Control can be easily adjusted to the (type of) tool, user or use, which requires only reasonably limited adjustments to the controller 13 and the ESC embodied thereby. Here, a few examples are noted:

operating pressure may be limited when an extension is added to a ram as described above in relation to FIG. 9, wherein a sensor 52 can be provided to detect whether or not an extension is actually connected to the piston 111 or to the back stud 59, which constituted a smart tool extension, or a proximity sensor mounted on the extension may provide information on approach to a car wreck post or an intermediate obstacle;

operating pressure can be limited when an integrated ram support 44 is provided, wherein a sensor 52 can be provided, which is configured to detect whether such a ram support is actually arranged on the ram, which is a further embodiment of smart tool extension, whereby such an integrated ram support can form an alternative for a separate ram support, whereby the tool and in particular the ram of FIG. 9 can be more quickly deployed and can be made safer to operate;

operating pressure may be limited with the objective of protecting the user/operator, but by providing an user operable override button or switch, to specifically enable higher pressures, does the controller allow a maximum pressure to be deployed, by appropriate adaptation of the characteristic graphs of FIG. 12, to allow for instance temporarily an increased operating pressure, which in normal operation enhances safety for the user, who is made thereby extra aware that the input command involves additional risks, but has an overdrive capability at his disposal for extraordinary circumstances;

a broad range of tools may be equipped with essentially the same drive formed by at least motor, pump and controller, where, with simple adjustments to the programming software of the controller 13 defining the electronic speed control "ECS", smaller tools can exhibit a more limited speed than larger tools (small and large being used here to refer to the movement ranges thereof).

Tools according to the present disclosure do not require a pressure limiting valve, because the controller 13/ESC may ensure that a safe operation speed is not exceeded, whereby the controller 13 may determine a maximum operating pressure based on motor torque and a desired transmission characteristic, with reference to the transmission stages in FIG. 12, based on the involvement of a selected number of chambers 33, to gear up or down.

In contrast, when a pressure sensor 52 is deployed, a pressure measurement signal from such a pressure sensor 52 may be beneficially employed to switch the stages, i.e. determine the number of chambers 33 to contribute, and/or gear down the motor 55, 111 to prevent damage to the tool by preventing excessive pressure from the pump.

If or when the maximum motor torque is reached at the highest operating pressure from the pump, the motor 55, 111 can be geared down, reduced or stalled by controller 13 to save energy, compared with a pressure limiting valve or a switching valve, and moreover the user/operator is more detectably informed that the maximum power of the tool has been reached, in that the user/operator receives a manually detectable (the user/operator is able to feel the change of the motor gearing down) warning that limits of operation of the tool have been reached.

As mentioned above, excessive heating of the motor, but also of the battery, controller and pump, can be detected by furnishing appropriate temperature sensors 52 for the controller to limit motor current, when a threshold temperature is exceeded. Gearing down under such circumstances can be referred to as "derating", which is in principle known in prior art tools, in which such a function is realized using hydraulic switch valves in which a derating control limits the motor torque to such an extent, that the switch pressure of the hydraulic switch valves cannot arise, in which case the tool is no longer operable to generate high forces. In contrast, the present disclosure allows the tool to remain operable, also during derating, because the controller 13 can switch the pump to any of its stages (combination of contributing chambers 33). However, derating involves reducing the motor torque and consequently also involves a reduction of a maximally attainable operating pressure and/or flow and speed, but this still enables the tool to maintain functionality, and involves a marked improvement over the prior art tools, which shut down completely, which is undesirable, in particular (though not exclusively) in case of rescue tools.

In the present disclosure, switching stages (i.e. determining the numbers of contributing chambers) may be performed based on a motor speed signal from a motor speed sensor 52 sent to controller 13. The controller 13 may then limit, if desired or even necessary, motor current and therefore also motor torque, to under a predetermined maximum threshold value. For example, relationships between motor speed signals and attainable pressures and/or flows may be stored in a memory for the controller to retrieve and base control over the pump on. When a load warrants such a torque, controller 13 may reduce motor speed. A pump chamber 33 is omitted and consequently "switched off", when motor speed exceeds a lower threshold. Conversely, a chamber 33 may be added to contribute, when motor speed exceeds an upper threshold.

Losses in the pump are determined to a considerable extent by leakages along a piston in a chamber 33 and a chamber wall. Particles in such a leakage flow may cause wear of the piston and the chamber wall. Since the leakage flow increases with the pump pressure, chambers 33 undergoing in the stage (combination of chambers contributing) suffer the most from this wear. By assigning alternating chamber to such stages undergoing the highest pressures, the overall life expectancy of the pump can be lengthened. By assigning differing stage ring 10 positions for the same stages (i.e. number of contributing chambers 33) different chambers will be involved in the different stages, allowing the distribution of wear and tear over the chambers and thereby the life of the pump may be lengthened.

When the controller 13 is configured to assign alternating or rotating chambers 33 and pistons therein for each stage, the life expectancy of the pump may be lengthened. To this end, stage ring 10 may carry an appropriately chosen number and extent of lips 49, and the stage ring can be rotated by motor 11 under control of controller 13 to a diversity of different rotational positions in which lips 49 exclude and include differing contributing chambers 33. It is further conceivable that such a drive of stage ring 10 is controlled by controller 13 by means of self-diagnosis to determine whether any of the chambers 33 are subject or susceptible to eminent wear. If so, other chambers 33 and pistons therein may be selected for appropriate stages, in particular for high pressure or speed stages involving a larger or lower number of the chambers 33. Self-diagnosis may be possible on the basis of the controller 13 receiving input about the tool in its end position of the work cylinder piston, measuring the operating pressure, when the tool is in the end position thereof. Worn chambers 33/pistons therein can be detected, by determining if the maximum power is not reached or reached too slowly.

Upon assembly, a program may be run by an end user or a mechanic to initially adjust the tool, wherein the tool may be calibrated, and operated to this end for a time under load. An external filter may be provided to be connected to the tool.

An end user or mechanic may initiate a diagnosis program for self diagnosis of the tool according to the present disclosure. In such a diagnosis, the controller 13 may verify if required pressures are achieved for each of the stages, or wherein ail pistons 28, 50 of the pump are arranged in a position with the smallest volume to determine whether and how quickly maximum pressure is achieved by the pistons in the respective chambers 33.

In conventional tools, motor speed in rpm is normally always constant, hut speed of the motor may be varied, where, for example, a hydraulic valve may be employed to regulate speed of the conventional tool. However, thereby reduction or shut off losses may occur. In contrast, according to the present disclosure, controller 13 may regulate speed of the motor, without reduction or shut off losses. Since in the tool, proposed herein, stages of the pump are also under control of the controller 13, a stage may be selected at any given time and regulation of speed the motor 14, 15 may therein also be takers into account. Further, a desired tool speed value, input by a user turning grip 141, may additionally also be taken into account, for selecting the stage of the pump and speed of the motor.

Variable motor speed allows an increase in the range of the drive; using a relatively low motor torque, the motor may reach a maximum speed and the user may be made available the highest speed. Such a maximum speed may be limited by battery voltage, where the motor speed and the associated electromagnetic force can be increased until a balance occurs with battery voltage. Nevertheless, motor speed can be increased even further, by deploying field weakening. Since the controller 13 is informed about a stage of the pump, field weakening may be selectively deployed in a stage with the largest cycle volume. Then, in other stages, a disadvantage of lower efficiency associated with field weakening does not apply, but the advantage of a higher tool speed is ensured in the relevant stage.

Groove 29 at port 30 ensures an improved fill of the chamber 33, so that even at higher speeds, the pump may function to expectation. A better fill of the chamber could also be achieved by providing a plurality of input channels, but then additional input channels ail need to be also blocked during the press half of the piston cycle to prevent fluid from being pressed back to the reservoir or tank 26, and/or during the suction half of the piston cycle to adapt the total work volume of the pump in accordance with the characterizing portion of appended independent claim 1, which renders a resulting design of the pump and/or of valves in particular more complex.

The configuration according to FIG. 6 relates to an optimized piston head design, according to which a resulting sideways force on the piston is minimized. A larger contact radius may be achieved for a curved piston head 54, whereby Hertze tension is reduced and conditions for elastobydrodynamic lubrication are improved. Friction losses at the swivel plate 51 and in contact between piston 28, 50 and chamber 33 may be reduced thereby, whereby shorter pistons are possible and a more compact pump may be realized.

Piston holding plate 36, 48 in FIG. 5 engages pistons in groove 61, which is more easily formed by milling than when diameters of pistons are increased to form a flange for engagement by the holding plate 36, 48. Holes in the holding plate for engaging piston heads are key shaped, which is shown in FIG. 7. This allows for easy mounting of the holding plate after inserting pistons 28, 50 into chambers 33. Further, this enhances contact between the pistons and the holding plate 36, 48, when filling chambers 33. Alternatively, a holding plate may have slots extending radially inward for engaging therein the piston heads, which allows for a higher number of chambers distributed around the circumference of the pump piston housing 9. A configuration of a piston holding plate is more compact than a configuration using springs on the pistons, and are more rigid and stiff, allowing higher operating speeds.

Spring 35 in FIG. 5 between pump piston housing 9 and piston holding plate 36, 48 embodies a simplification, and contributes to a more compact design, providing more room for the spring 35

Above, numerous described features are explained in conjunction with their benefits in relation to alternatives. Also, the portable tool of the present disclosure, often referred to herein above in an embodiment of a rescue tool, may be useable/applicable for other purposes, such as for example in other embodiments than rescue tools, such as re-railing systems, synchronous lifting systems, skidding systems, demolition, recycling, and the like. However, also alternatives for features defined in any of the appended claims, which may be less preferred, may also fall within the scope of the present disclosure, as defined in the appended claims, where also other alternatives for the specifically disclosed features may be encompassed thereby, and the scope is only limited to the definitions of the appended claims, and may also include, at least for some jurisdictions, obvious alternatives for claimed features.

The invention claimed is:

1. A portable tool, capable of being moved by persons, users and/or operators, comprising:

a motor;

an actuable tool component at least connectable to the motor;

an elongate extension, having a length and a connector at an end, configured to be selectively placed with the connector on the tool or on the tool component; and a controller connected to the motor and configured to determine presence of the elongate extension on the tool or on the tool component to selectively increase or reduce force and/or speed, depending on detected presence or absence of the elongate extension;

wherein the tool is a rescue tool from a group of rescue tools comprising: a ram; a spreader; and a cutter.

2. The portable tool of claim 1, wherein the elongate extension comprises an identifier configured to communicate its presence to the controller.

3. The portable tool of claim 2, wherein the identifier of the elongate extension is configured to indicate its presence on the tool through a signal over a wire or wirelessly.

4. The portable tool according to claim 1, further comprising:

a fluid reservoir;

a pump connected to the reservoir and the motor;

a work cylinder connected to an output of the pump; wherein the actuable tool component is connected to the work cylinder; and a sensor in the rescue tool connected to any one or more than one of the motor, the reservoir, the pump, the work cylinder, and the tool;

wherein the controller is configured to receive measurement signals from the sensor; and wherein at least one controlled valve is in a hydraulic circuit defined by the reservoir, the pump and the work cylinder and connected to the controller, wherein the controlled valve and the controller are configured to selectively at least substantially block or open any fluid channel in the hydraulic circuit.

5. The portable tool of claim 4, wherein the pump has a plurality of chambers, each of which comprises a fluid input channel extending from a reservoir to the chamber for fluid supply, a pressurised fluid output port and a piston, wherein the motor is configured to cyclically move the piston in the chamber to supply fluid from the reservoir via the input channel into the chamber during a suction half of the piston cycle and to forcibly press fluid out through the output port during a press half of the piston cycle, wherein the input channel is blocked during the press half of the piston cycle; and wherein the controlled valve is configured to selectively at least substantially block the input channel of at least one of the plurality of chambers of the pump during at least a part of the suction half of the piston cycle, independent of the piston cycle.

6. The portable tool according to claim 1, further comprising at least one performance sensor providing, to the controller, information for the controller to adapt tool operation to the information, wherein the sensor is configured to measure and provide the information on at least one performance parameter from a group comprising: fluid pressure from the pump, current drawn by the motor, revolutions per time unit of the motor, torque supplied by the motor, power delivered and/or consumed by the motor, battery charge if the tool comprises a battery, rotational position of the motor, position and/or a movement of a piston in the work cylinder, approximation of an predetermined extension of the piston from the work cylinder, such as maximum and/or minimum extension, ambient temperature, fluid temperature, motor temperature, motor resistance, fluid resistance, controlled valve position, and user and/or operator input.

7. The portable tool according to claim 1, further comprising at least one detector providing, to the controller, information for the controller to adapt tool operation to the information, wherein the detector is configured to determine and provide the information on at least one parameter from a group comprising: presence of the tool component and/or an extension thereof, connection to a mains power supply, water intrusion into the tool, and a low battery level if the tool comprises a battery.

8. The portable tool according to claim 1, further comprising a battery, wherein the tool is self-contained without external connections, except for a power supply connector for charging the battery.

9. A method of operating a portable tool, capable of being moved by persons, users and/or operators, wherein the tool comprises:

a motor;

an actuable tool component at least connectable to the motor; and an elongate extension, having a length and a connector at an end, configured to be selectively placed with the connector on the tool or on the tool component;

wherein the method comprises determining presence of the elongate extension on the tool or on the tool component; and selectively increasing or reducing force and/or speed, depending on detected presence or absence of the elongate extension; and wherein the portable tool is a rescue tool from a group of rescue tools comprising: a ram; a spreader; and a cutter.

10. A portable tool, capable of being moved by persons, users and/or operators, comprising:

a motor;

an actuable tool component at least connectable to the motor;

an elongate extension, having a length and a connector at an end, configured to be selectively placed with the connector on the tool or on the tool component; and a controller connected to the motor and configured to determine presence of the elongate extension on the tool or on the tool component to selectively increase or reduce force and/or speed, depending on detected presence or absence of the elongate extension; and a battery, wherein the tool is self-contained without external connections, except for a power supply connector for charging the battery.

* * * * *